United States Patent [19]

Briggs

[11] 4,158,413

[45] Jun. 19, 1979

[54] COLLAPSIBLE-PORTABLE TOOTHBRUSH HOLDER

[76] Inventor: Rebecca R. M. Briggs, 1505 Flagler Ave., Key West, Fla. 33040

[21] Appl. No.: 834,455

[22] Filed: Sep. 19, 1977

[51] Int. Cl.[2] ..... A47B 81/02

[52] U.S. Cl. ..... 211/65; 211/100

[58] Field of Search ..... 221/249; 132/84 R, 84 D; 211/66, 85, 100, 99, 101, 171, 65

[56] References Cited

U.S. PATENT DOCUMENTS

| | | | |
|---|---|---|---|
| 2,256,109 | 9/1941 | Blaisdell | 211/100 X |
| 3,141,712 | 7/1964 | Holmes et al. | 211/66 X |

*Primary Examiner*—Stanley H. Tollberg

[57] ABSTRACT

This invention relates to a toothbrush holder that will hold and support toothbrushes when in the open, upright position, and can be closed and transported when the toothbrushes are removed.

1 Claim, 2 Drawing Figures

COLLAPSIBLE-PORTABLE TOOTHBRUSH HOLDER

Although many homes in the United States are equipped with mounted on free-standing toothbrush holders, most bathrooms in hospitals, hotels and motels do not contain toothbrush holders for patients or patrons. This invention is a small, compact and simple device that will stand upright, supporting toothbrushes when open, can be transported for convenience and sanitation when closed, and can be used once or repeatedly.

Figure 1:
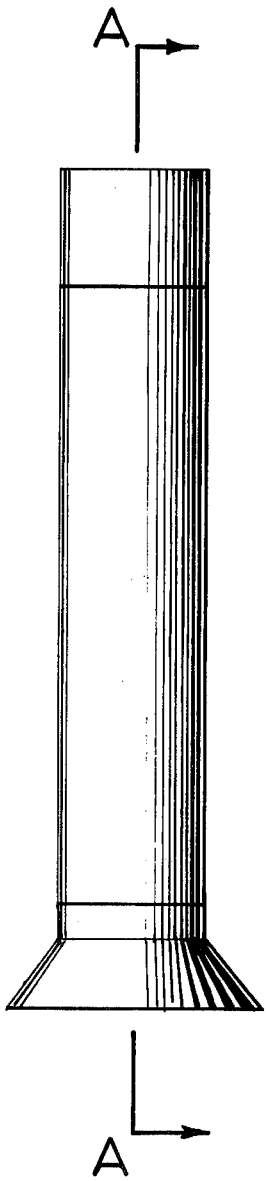
FIG. 1 is a view of the device in the closed, portable position.
Figure 2:
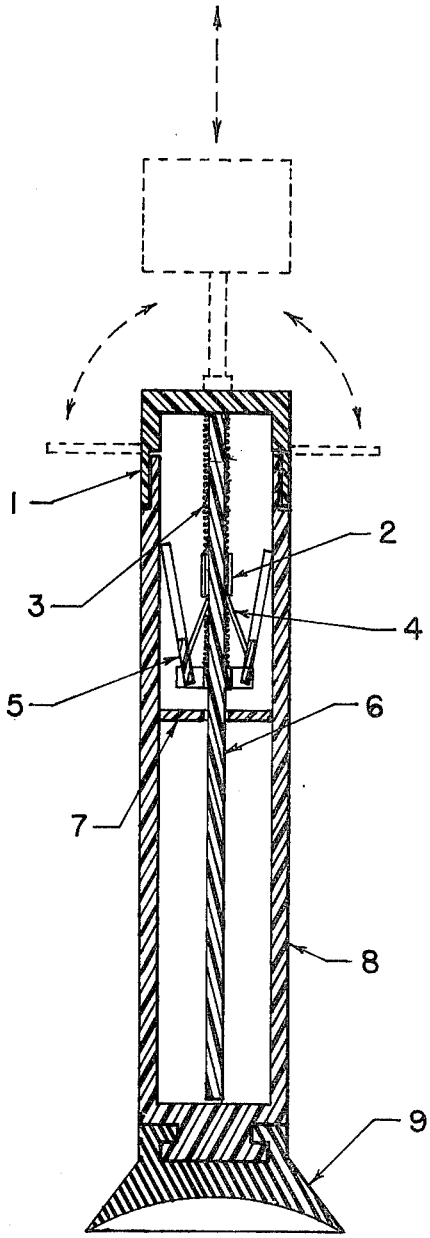
FIG. 2 is a sectional view showing the device in the open (dotted) and closed positions.

Referring to the drawing, FIG. 2, the device of this invention comprises a hollow tubular casing 8 closed at its lower end and with a shouldered boss to interlock with the suction cup base 9. The upper end of the casing wall is reduced in thickness to make a smooth exterior surface when closed with cap 1. Shaft 6 is affixed to the underside of cap 1 and is retained in a position axial to the casing by guide 7. Affixed to shaft 6 is a cross bar containing pivots about which brush holders 5 may rotate to the horizontal position. Brush holders 5 are connected to sleeve 2 by arms 4 such that sliding sleeve 2 downward along shaft 6 will cause arms 5 to extend outward. Shaft 6 contains a knurled friction surface 3 extending the length of travel of sleeve 2. The length of arms 4 and the location of their pivot points on brush holders 5 are such that brush holders 5 are in the horizontal position when sleeve 2, in its downward travel, encounters the cross bar pivot of brush holder 5.

Raising cap 1 free of casing 8 draws shaft 6 upward until brush holders 5 are above the open mouth of the casing at which point sleeve 2 is pressed downward along friction surface 3 until brush holders 5 are locked in the horizontal position and will support the moveable assembly by resting on the mouth edge of casing 8. At this point, brush holders 5 will carry one toothbrush per brush holder. The brush holders 5 are recessed to support toothbrushes at their neck, commonly located directly below the bristle area.

Upon removing toothbrushes, downward pressure on cap 1 will cause brush holders 5 to rotate upward by reaction with the mouth edge of casing 8 and cause sleeve 2 to move upward along the friction surface 3 by the force exerted along arms 4. Continued downward pressure on cap 1 will cause the entire assembly to retract into casing 8 until cap 1 engages the shoulder around the upper mouth of casing 8. A small residual tension resulting from sleeve 2 being forced along friction surface 3 is transmitted via arms 4 to brush holders 5 causing them to press outward against the inner wall of casing 8 thereby holding the assembly in the closed position.

I claim:

1. A device that stands in an upright position when open supporting two or more toothbrushes and can be closed and transported when toothbrushes are removed comprising a base that can be removable or permanently attached; a tubular casing that is closed at its lower end with a shouldered boss to interlock with said base with the upper end of said casing wall reduced in thickness to make a smooth exterior surface when said casing is closed with a cap, said casing containing a shaft affixed to the underside of said cap and retained in a position axial to said casing by a vertical rod guide connected to the inside of said casing wall, a cross bar that is affixed to said shaft containing pivots about which brush holders may rotate to a horizontal position connected by arms to an operating sleeve that slides along a knurled friction surface extending the length of travel of said sleeve when opening and closing the device; the operation is such that when said cap is raised said shaft is drawn upward and said operating sleeve is pressed downward causing said brush holders to extend outward to the horizontal position and when said cap is pressed downward, said operating sleeve will slide upward on said shaft, at which time said brush holders will fold upward and, with continued downward pressure on said cap, will slide downward into said casing; said cap is then secured on top of said casing thereby closing the device.

* * * * *